US011562691B2

(12) United States Patent
Wu et al.

(10) Patent No.: US 11,562,691 B2
(45) Date of Patent: Jan. 24, 2023

(54) GRAY SCALE DISPLAY METHOD

(71) Applicants: Chengdu BOE Optoelectronics Technology Co., Ltd., Sichuan (CN); BOE Technology Group Co., Ltd., Beijing (CN)

(72) Inventors: Guoqiang Wu, Beijing (CN); Chungkee Cheng, Beijing (CN); Yuanzhou Hu, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/465,655

(22) Filed: Sep. 2, 2021

(65) Prior Publication Data

US 2022/0068200 A1 Mar. 3, 2022

(30) Foreign Application Priority Data

Sep. 3, 2020 (CN) ..... 202010917808.1

(51) Int. Cl.
*G09G 3/3225* (2016.01)

(52) U.S. Cl.
CPC ... *G09G 3/3225* (2013.01); *G09G 2320/0233* (2013.01); *G09G 2320/0242* (2013.01); *G09G 2320/0271* (2013.01)

(58) Field of Classification Search
CPC ..... G09G 2320/0242; G09G 3/3225; G09G 2320/0233; G09G 2320/0271
See application file for complete search history.

(56) References Cited

U.S. PATENT DOCUMENTS

| | | | | |
|---|---|---|---|---|
| 7,317,460 | B2 * | 1/2008 | Kim | G09G 3/3611 348/674 |
| 9,053,664 | B2 * | 6/2015 | Lee | G09G 3/2025 |
| 2014/0160174 | A1 | 6/2014 | Tsuei et al. | |
| 2017/0116902 | A1 | 4/2017 | Kuo et al. | |
| 2017/0301095 | A1 | 10/2017 | Zhang et al. | |
| 2018/0233107 | A1 | 8/2018 | Wu | |
| 2019/0088187 | A1 | 3/2019 | Yan | |
| 2019/0347777 | A1 | 11/2019 | Meng et al. | |

(Continued)

FOREIGN PATENT DOCUMENTS

| | | | |
|---|---|---|---|
| CN | 1956495 | A | 5/2007 |
| CN | 104699438 | A | 6/2015 |
| CN | 106127709 | A | 11/2016 |

(Continued)

OTHER PUBLICATIONS

CN 2020109178081 first office action.

*Primary Examiner* — Hang Lin
(74) *Attorney, Agent, or Firm* — IPro, PLLC

(57) ABSTRACT

A gray scale display method is provided. The method includes: dividing a matrix arrangement taking a pixel unit as a display unit into a matrix arrangement taking a plurality of pixel units as the display unit, where the display unit including the plurality of pixel units is a pixel module, and the pixel unit includes at least one sub-pixel; in a case that an average gray scale of the pixel module is smaller than a preset value, displaying a part of the pixel units of the pixel module with a preset gray scale, where the preset gray scale is larger than the average gray scale.

14 Claims, 3 Drawing Sheets

(56) References Cited

U.S. PATENT DOCUMENTS

2020/0226987 A1 7/2020 Shan

FOREIGN PATENT DOCUMENTS

| | | | |
|---|---|---|---|
| CN | 106157869 | A | 11/2016 |
| CN | 106228935 | A | 12/2016 |
| CN | 106886386 | A | 6/2017 |
| CN | 106910487 | A | 6/2017 |
| CN | 107808648 | A | 3/2018 |
| CN | 107978289 | A | 5/2018 |
| CN | 108780571 | A | 11/2018 |
| CN | 109192174 | A | 1/2019 |
| CN | 110264950 | A | 9/2019 |
| CN | 110728944 | A | 1/2020 |
| CN | 111563851 | A | 8/2020 |
| TW | 201423706 | A | 6/2014 |

* cited by examiner

GRAY SCALE DISPLAY METHOD

CROSS-REFERENCE TO RELATED APPLICATIONS

This present disclosure claims priority to Chinese Patent Application No. 202010917808.1 filed in China on Sep. 3, 2020, the entire contents of which are incorporated herein by reference.

TECHNICAL FIELD

The present disclosure relates generally to the field of display technology, and more particularly to a gray scale display method.

BACKGROUND

At present, due to inherent defects of an AMOLED (Active-matrix organic light-emitting diode) display device, the display effect of a low-gray scale image is not ideal enough, the color coordinates and the standard gamma curve have a larger deviation, and the lower the gray scale is, the larger the deviation is. That is, when a low-gradation picture is displayed, there is a deviation in color. The poor display effect of the low gray scale image becomes one of the main defects of the AMOLED screen.

SUMMARY

A gray scale display method is provided in the present disclosure, including:

dividing a matrix arrangement taking a pixel unit as a display unit into a matrix arrangement taking a plurality of pixel units as the display unit, where the display unit including the plurality of pixel units is a pixel module, and the pixel unit includes at least one sub-pixel;

in a case that an average gray scale of the pixel module is smaller than a preset value, displaying a part of the pixel units of the pixel module with a preset gray scale, where the preset gray scale is larger than the average gray scale.

Optionally, the displaying a part of the pixel units of the pixel module with the preset gray scale includes:

in a case that the pixel module includes two rows and two columns of pixel unit, displaying each of the pixel units with the preset gray scale.

Optionally, the displaying a part of the pixel units of the pixel module with the preset gray scale includes:

in a case that the pixel module includes two rows and two columns of pixel unit, displaying two pixel units at each diagonal line with the preset gray scale.

Optionally, the preset gray scale values of two pixel units at a diagonal line are the same.

Optionally, in a case that the average gray scale of the pixel module is smaller than a preset value, the displaying a part of the pixel units of the pixel module with the preset gray scale includes:

calculating a gray scale variance of the pixel module;

in a case that the gray scale variance is smaller than a preset variance value, displaying a part of the pixel units of the pixel module with the preset gray scale.

Optionally, the displaying a part of the pixel units of the pixel module with the preset gray scale includes:

determining the preset gray scale of the part of the pixel units, according to a corresponding relation between gray scale and brightness of the pixel module.

Optionally, the displaying a part of the pixel units of the pixel module with the preset gray scale includes:

displaying the pixel units of at two diagonal lines in the pixel module sequentially in turn at different module display time, where the module display time is a display time of a frame of picture displayed by the pixel module.

Optionally, the displaying a part of the pixel units of the pixel module with the preset gray scale includes:

displaying four pixel units in the pixel module sequentially in turn at different module display time, where the module display time is a display time of a frame of picture displayed by the pixel module.

A gray scale display method is provided in the present disclosure, including:

determining a quantity of rows and columns of pixel units in a pixel module, and determining the pixel units for display in the pixel module;

determining whether to perform a module display of the pixel module;

determining a gray scale value of each pixel unit in the pixel module; and determining an in-turn display mode.

Optionally, the determining whether to perform the module display of the pixel module includes:

determining whether to divide the pixel module for display, by calculating an average gray scale and a gray scale variance of the pixel module.

Optionally, the determining whether to divide the pixel module for display by calculating the average gray scale and the gray scale variance of the pixel module includes:

in a case that the average gray scale of the pixel module is smaller than a set value, dividing the pixel module for displaying; or in a case that the average gray scale of the pixel module is smaller than a set value and the gray scale variance is smaller than a preset variance value, dividing the pixel module for displaying.

Optionally, the determining the gray scale value of each pixel unit in the pixel module includes:

determining the gray scale value of each pixel unit in the pixel module corresponding to each frame picture, according to a corresponding relation between gray scale and brightness of the pixel module.

Optionally, the determining the in-turn display mode includes:

displaying the pixel units of at two diagonal lines in the pixel module sequentially in turn at different module display time, where the module display time is a display time of a frame of picture displayed by the pixel module.

Optionally, the determining the in-turn display mode includes:

displaying four pixel units in the pixel module sequentially in turn at different module display time, where the module display time is a display time of a frame of picture displayed by the pixel module.

BRIEF DESCRIPTION OF THE DRAWINGS

Other features, objects of the present disclosure will become more apparent upon reading of the detailed description of the embodiments made with reference to the following drawings.

DETAILED DESCRIPTION

Figure 1:
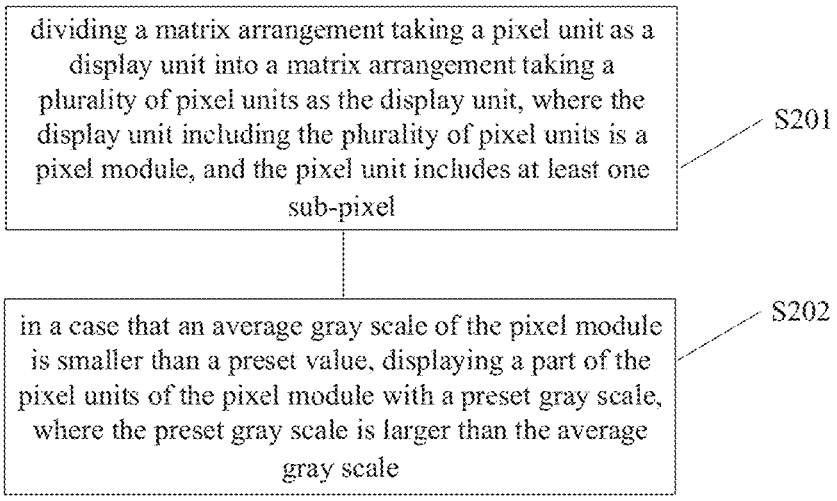
FIG. 1 illustrates an exemplary flow chart of a gray scale display method according to an embodiment of the present disclosure.

The present disclosure will be described in further detail with reference to the drawings and examples. It is to be understood that the specific embodiments described herein are merely illustrative of the disclosure and are not to be construed as limiting the disclosure. It should be noted that, for convenience of description, only the portions related to the present disclosure are shown in the drawings.

Unless defined otherwise, technical or scientific terms used herein should have the same meaning as commonly understood by one of ordinary skill in the art to which this disclosure belongs. The use of "first," "second," and the like in this disclosure is not intended to indicate any order, quantity, or importance, but rather is used to distinguish one element from another. The word "comprising" or "comprises", and the like, means that the element or item preceding the word comprises the element or item listed after the word and its equivalent, but does not exclude other elements or items. The terms "connected" or "coupled" and the like are not restricted to physical or mechanical connections, but may include electrical connections, whether direct or indirect. "upper", "lower", "left", "right", and the like are used only to indicate relative positional relationships, and when the absolute position of the object being described is changed, the relative positional relationships may also be changed accordingly.

It should be noted that, in the present disclosure, the embodiments and features of the embodiments may be combined with each other without conflict. The present disclosure will be described in detail below with reference to the accompanying drawings in conjunction with embodiments.

The related art AMLED display device has the following problems: due to the inherent disadvantages of an Active-matrix organic light-emitting diode (AMOLED) display device, the display effect of a low-gray scale image is not ideal enough, the color coordinates and the standard gamma curve have a larger deviation, and the lower the gray scale, the larger the deviation. That is, when a low-gradation picture is displayed, there is a deviation in color.

In order to solve the above technical problems, the present disclosure provides a gray scale display method and a display device.

FIG. 1 shows an exemplary flow chart of a gray scale display method according to an embodiment of the present disclosure. As shown in FIG. 1, a gray scale display method comprises the following steps:

S201: dividing a matrix arrangement taking a pixel unit as a display unit into a matrix arrangement taking a plurality of pixel units as the display unit, where the display unit including the plurality of pixel units is a pixel module, and the pixel unit includes at least one sub-pixel;

S202: in a case that an average gray scale of the pixel module is smaller than a preset value, displaying a part of the pixel units of the pixel module with a preset gray scale, where the preset gray scale is larger than the average gray scale.

According to the embodiment of the present disclosure, when the average gray scale of the pixel module is smaller than the preset value, part of the pixel units of the pixel module are used for displaying according to the preset gray scale, so that the problem of color deviation of low-gray scale image display can be solved. Further, according to some embodiments of the present disclosure, the display uniformity problem and the aging equalization problem can be solved by displaying the pixel units in the pixel module in turn.

Figure 2:
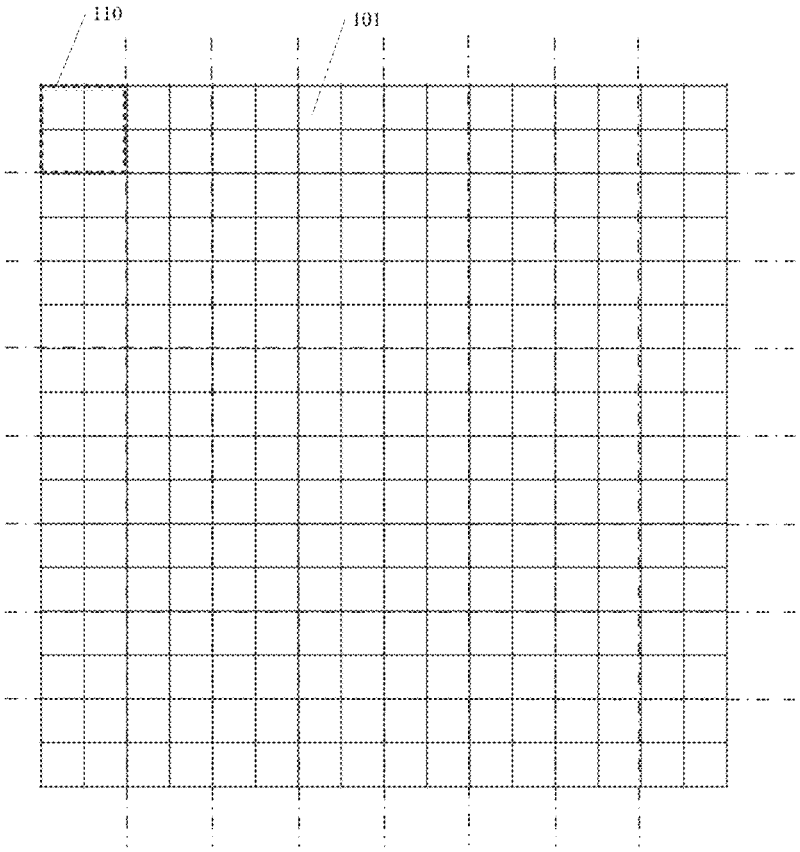
FIG. 2 is a schematic view of a division of a display area according to an embodiment of the present disclosure.
Figure 3:
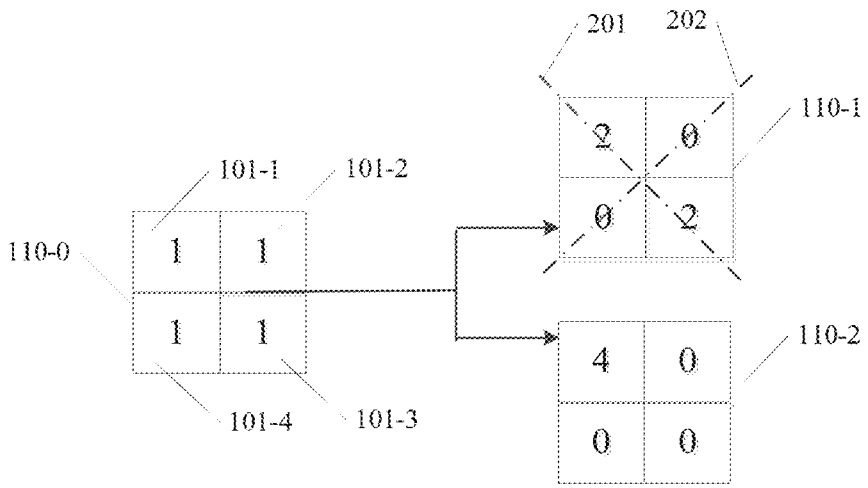
FIG. 3 is a schematic view of a pixel module according to an embodiment of the present disclosure.

The following description is made with reference to FIGS. 2 and 3.

FIG. 2 shows a schematic division of a display area according to an embodiment of the present disclosure. As shown in FIG. 2, a display area in which RGB (red, green, blue) pixel cells are a basic display unit is given. In the present disclosure, in order to avoid a color shift problem caused by writing a low gray scale into a pixel unit, the display area is subdivided to display a display unit including a plurality of pixel units as a minimum display unit, and the minimum display unit including a plurality of pixel units is referred to as a pixel module 110 for convenience of description. FIG. 2 shows only pixel modules including two rows and two columns (2×2) of pixel elements, and may also include pixel modules including two rows and four columns (2×4) or four rows and four columns (4×4) of pixel elements. And is not limited thereto. The pixel unit includes at least one sub-pixel, for example, one pixel unit includes three sub-pixels of red, green and blue, or four sub-pixels. The number of sub-pixels in a pixel unit is not limited herein.

As shown in FIG. 3, a word pixel module includes four pixel units 101-1, 101-2, 101-3, and 101-4, at this time, the gray levels to be written into the pixel units are G1, G2, G3, and G4, and the average gray level is the gray level Ga of the pixel module 110 as follows:

$$G_a = \frac{(G_1 + G_2 + G_3 + G_4)}{4} \qquad \text{equation 1}$$

When the value of the gray scale Ga of the pixel module 110-0 is smaller than the preset value, a part of the pixel units of the pixel module displays with the preset gray scale. It can be understood that the preset value may be set according to an actual present disclosure scenario, and is not limited herein.

Specifically, a preset value $\alpha$ is set, and when $G_a > \alpha$, the pixel module is in high gray scale display, the pixel module is not displayed, and normal display with the pixel unit as the minimum display unit is carried out; when $G_a < \alpha$, the pixel module is in low gray scale display, and the display divided into the pixel modules is required.

"0" in FIG. 3 indicates a pixel unit to which no gray scale is written, that is, the pixel unit does not participate in display. "1", "2", and "4" indicate pixel units of written gray scales, and indicate that these pixel units participate in display. It is to be understood that the numerical value does not represent a true value, and is used to represent a magnitude relationship between them. It can be seen that only two of the four pixel units of the pixel module 110-1 in FIG. 3 participate in the display, only one of the four pixel units of the pixel module 110-2 participate in the display, and a portion of the pixel units of the pixel module display in a preset gray scale greater than the average gray scale. This avoids the problem of color shift due to low gray levels.

In some embodiments, the displaying a part of the pixel units of the pixel module with the preset gray scale includes:

in a case that the pixel module includes two rows and two columns of pixel unit, displaying each of the pixel units with the preset gray scale.

As shown in FIG. 3, the pixel module 110-2 includes four pixel units at two rows and two columns, where one pixel unit participates in the display. The pixel unit participating in the display may be any one of four pixel units of two rows and two columns.

In some embodiments, the displaying a part of the pixel units of the pixel module with the preset gray scale includes:

in a case that the pixel module includes two rows and two columns of pixel unit, displaying two pixel units at each diagonal line with the preset gray scale.

As shown in FIG. 3, the pixel module 110-1 includes four pixel units of two rows and two columns, two of which participate in the display, and the two pixel units are located on a diagonal line 201 of the pixel module 110-1. The pixel units participating in the display may be two pixel units located on any one of the diagonal 201 and the diagonal 202, which is not limited herein.

In some embodiments, in a case that the average gray scale of the pixel module is smaller than a preset value, the displaying a part of the pixel units of the pixel module with the preset gray scale includes:

calculating a gray scale variance of the pixel module;

in a case that the gray scale variance is smaller than a preset variance value, displaying a part of the pixel units of the pixel module with the preset gray scale.

As shown in FIG. 3, a pixel module includes four pixel units 101-1, 101-2, 101-3, and 101-4, in which case, the gray scales required to be written into the pixel units are G1, G2, G3, and G4, and the average gray scale is Ga, the gray scale variance S2 of the pixel module 110 is as follows:

$$s^2 = \frac{(G_1 - G_a)^2 + (G_2 - G_a)^2 + (G_3 - G_a)^2 + (G_4 - G_a)^2}{4} \quad \text{equation 2}$$

Setting a preset variance value β, when $G_a<\alpha$ and $\beta>s^2$, the brightness difference of each pixel gray of the pixel module is large, if the display processing of the pixel module is carried out, a large amount of picture details are lost, and therefore the pixel module displays according to a normal mode by taking a pixel unit as a minimum display unit; when $G_a<\alpha$ and $\beta<s^2$, the luminance difference of each pixel gray of the pixel block is small, and the pixel block is subjected to display processing.

Ga represents whether a certain pixel module works in a low-gray scale state or not, and $S^2$ represents the gray scale difference between the pixels in the pixel module, and also the brightness difference between the pixels in the pixel module.

In some embodiments, the displaying a part of the pixel units of the pixel module with the preset gray scale includes:

determining the preset gray scale of the part of the pixel units, according to a corresponding relation between gray scale and brightness of the pixel module.

Figure 4:
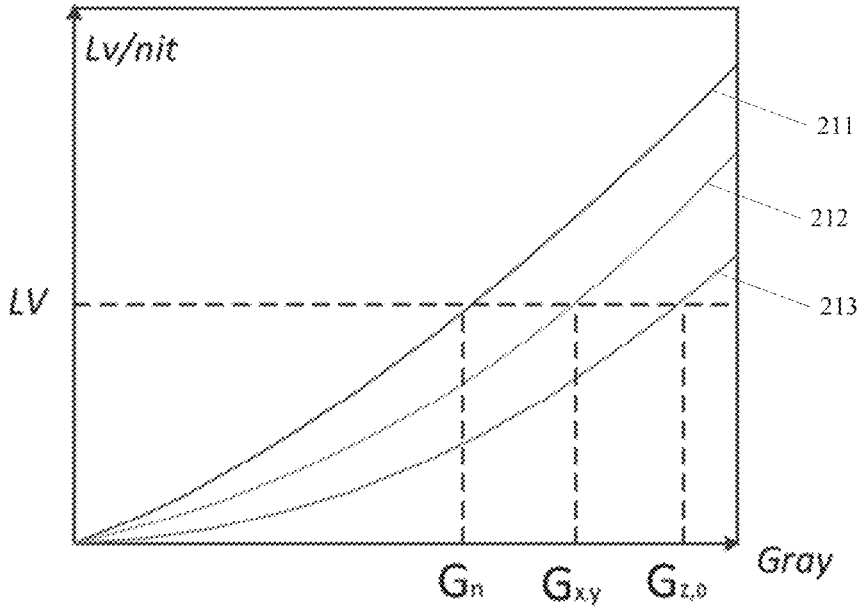
FIG. 4 is a schematic view of a gray-to-brightness relationship of a pixel module according to an embodiment of the present disclosure.

FIG. 4 is a diagram illustrating a gray-level-luminance relationship of a pixel module according to an embodiment of the present disclosure. In the figure, a curve 211, a curve 212 and a curve 213 respectively show the corresponding relationship curves between the gray scales and the brightness corresponding to the pixel module 110-0, the pixel module 110-1 and the pixel module 110-2. When a picture is displayed, the brightness LV of the pixel block in a normal display (a display mode in which the pixel unit is the minimum display unit) state is determined. Then, the gray values Gx, y and Gz, 0 of the pixel module 110-1 and the pixel module 110-2 corresponding to the brightness LV are determined respectively through the curve of the correspondence between gray levels and brightness in FIG. 3. It can be understood that, only a part of the pixel units of the pixel modules 110-1 and 110-2 participate in the display, so the brightness LV of each pixel unit participating in the display needs to be achieved, and the gray scale value needs to be increased. Under the same brightness LV, the gray scale of Gz, 0 will be larger than the gray scale value of Gx, y, which is larger than the gray scale value of Gn. Therefore, by increasing the gray scale value, the image quality problem caused by low gray scale is improved. The preset gray scale values of the two pixel units of the diagonal of the pixel module 110-1 may be the same.

In some embodiments, the displaying a part of the pixel units of the pixel module with the preset gray scale includes:

displaying the pixel units of at two diagonal lines in the pixel module sequentially in turn at different module display time, where the module display time is a display time of a frame of picture displayed by the pixel module; or displaying four pixel units in the pixel module sequentially in turn at different module display time, where the module display time is a display time of a frame of picture displayed by the pixel module.

Figure 5:
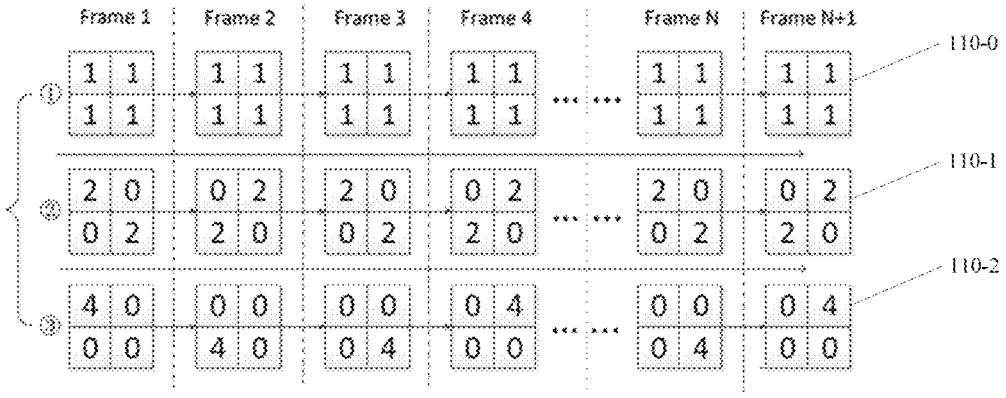
FIG. 5 is a schematic view of an in-turn display of pixel modules according to an embodiment of the present disclosure.

In order to avoid the display non-uniformity and aging non-uniformity problems caused by the fact that the pixel units participating in the pixel module display are in the starting state for a long time and the other part of the pixel units are in the closing state for a long time, the specific scheme is as follows through an in-turn display mode:

FIG. 5 is a schematic view of an in-turn display of pixel modules according to an embodiment of the present disclosure. As shown in FIG. 5, a schematic view of the rotation display of the pixel module 110-0, the pixel module 110-1, and the pixel module 110-2 with the display time of each module is shown.

For the pixel module 110-1, two pixel cells located on the diagonal 201 are turned on and the other two are turned off when the module displays the time Frame 1; when the Frame display time Frame2 is displayed in the module, two pixel units on the diagonal 202 are turned on, the other two pixel units are turned off, and the subsequent display time Frame3 to the display time Frame N+1 are sequentially displayed in an in-turn manner. It is understood that two pixel cells located on the diagonal line 202 may be turned on and the other two turned off when the module displays the time Frame 1; when the module displays the time Frame2, two pixel units on the diagonal 201 are turned on, the other two pixel units are turned off, and the subsequent display time Frame3 to the display time Frame N+1 are sequentially displayed in an in-turn manner.

For the pixel module 110-2, when the module displays the time Frame1, the pixel unit in the first row and the first column is turned on, and the other pixel units are turned off; when the module displays the time Frame2, the pixel unit positioned in the second row and the first column is opened, and other pixel units are closed; when the module displays the time Frame3, the pixel unit in the second row and the second column is turned on, and the other pixel units are turned off; when the module displays the time Frame4, the pixel units in the first row and the second column are turned on, and the other pixel units are turned off. The subsequent display time Frame5 to the display time Frame N+1 are sequentially displayed in an in-turn manner. It is understood that the above-mentioned rotation sequences can be arranged in any order according to requirements, and are not limited herein.

Figure 6:
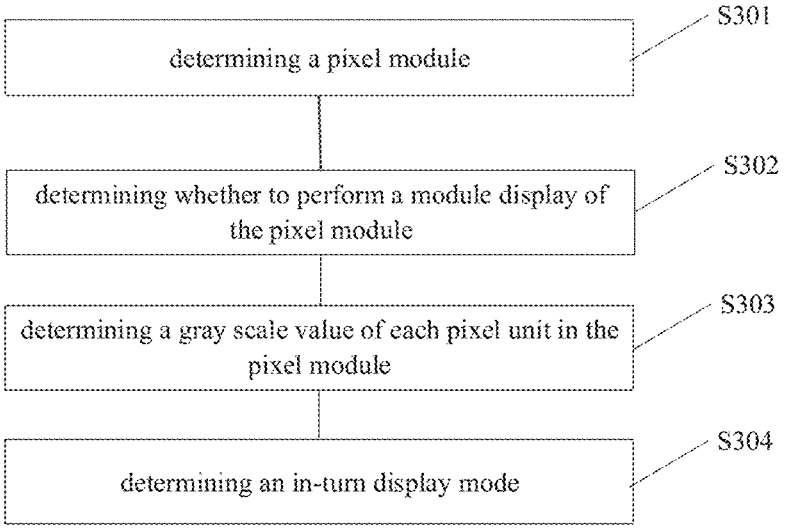
FIG. 6 is an exemplary flow chart of a gray scale display method according to an embodiment of the present disclosure.

For ease of understanding, a gray scale display method including all the modified methods is given below. FIG. 6 shows an exemplary flow chart of a gray scale display method according to an embodiment of the present disclosure, the method comprising the steps of:

S301: determining a pixel module;

S302: determining whether to perform a module display of the pixel module;

S303: determining a gray scale value of each pixel unit in the pixel module;

S304: determining an in-turn display mode;

In S301, it is determined whether the pixel module is a pixel module including several rows and columns of pixel units, for example, a pixel module including two rows and two columns (2×2) of pixel units, or a pixel module including two rows and four columns (2×4) or four rows and four columns (4×4) of pixel units, and determines which pixel cells in the pixel module participate in the display. For example, the pixel unit on the diagonal line participates in the module display, or only one pixel participates in the display. See the associated description of FIGS. 2 and 3 for details.

In step S302, it is determined whether the division into pixel module for display is required by calculating the average gray scale and gray scale variance of the pixel blocks. When the average gray scale of the pixel module is smaller than a set value, the pixel module is divided for displaying; or when the average gray scale of the pixel module is smaller than a set value and the gray scale variance is smaller than a preset variance value, the pixel module is divided to display. See the relevant description of equations 1 and 2 for details.

In step S303, the gray scale value of each pixel unit in the pixel module corresponding to each frame picture is determined, according to a corresponding relation between gray scale and brightness of the pixel module. See the description of FIG. 4 for details.

In step S304, in order to ensure the display uniformity and aging balance of each pixel unit, the pixel units in each pixel module adopt an in-turn display mode, for example, the pixel units between two diagonal lines are displayed in turn; alternatively, the single pixel unit is alternately displayed. See the associated description of FIG. 5 for details.

It should be understood that, for a pixel module, not every frame picture to be displayed needs to be divided into pixel module for display, so the display time of the pixel module is not necessarily continuous, and some frames are displayed in a normal manner, and some frames are displayed in a pixel module manner. Therefore, when the rotation display is stopped when the normal display is needed, and the module display is needed again subsequently, the in-turn display is carried out. Therefore, in order to distinguish from the frame display time, the concept of the module display time is introduced and used to indicate the display time of one frame of picture that needs to be displayed by the pixel module.

According to the embodiment of the present disclosure, when the average gray scale of the pixel module is smaller than the preset value, part of the pixel units of the pixel module are used for display according to the preset gray scale, so that the problem of color deviation of low-gray scale image display can be solved. Further, according to some embodiments of the present disclosure, the display uniformity problem and the aging equalization problem can be solved by displaying the pixel units in the pixel module in turn.

The foregoing description is only exemplary of the preferred embodiments of the present disclosure and is illustrative of the principles of the technology employed. It will be appreciated by a person skilled in the art that the scope of the disclosure according to the present disclosure is not limited to the specific combination of the above-mentioned features, but also covers other embodiments where any combination of the above-mentioned features or their equivalents is made without departing from the inventive concept. For example, the above features may be replaced with (but not limited to) features having similar functions disclosed in the present disclosure.

What is claimed is:

1. A gray scale display method, comprising:

dividing a matrix arrangement taking a pixel unit as a display unit into a matrix arrangement taking a plurality of pixel units as the display unit, wherein the display unit comprising the plurality of pixel units is a pixel module, and the pixel unit comprises at least one sub-pixel;

in a case that an average gray scale of the pixel module is smaller than a preset value, displaying a part of the pixel units of the pixel module with a preset gray scale, wherein the preset gray scale is larger than the average gray scale.

2. The gray scale display method according to claim 1, wherein the displaying a part of the pixel units of the pixel module with the preset gray scale comprises:

in a case that the pixel module comprises two rows and two columns of pixel unit, displaying each of the pixel units with the preset gray scale.

3. The gray scale display method according to claim 1, wherein the displaying a part of the pixel units of the pixel module with the preset gray scale comprises:

in a case that the pixel module comprises two rows and two columns of pixel unit, displaying two pixel units at each diagonal line with the preset gray scale.

4. The gray scale display method according to claim 1, wherein the preset gray scale values of two pixel units at a diagonal line are the same.

5. The gray scale display method according to claim 1, wherein in a case that the average gray scale of the pixel module is smaller than a preset value, the displaying a part of the pixel units of the pixel module with the preset gray scale comprises:

calculating a gray scale variance of the pixel module;

in a case that the gray scale variance is smaller than a preset variance value, displaying a part of the pixel units of the pixel module with the preset gray scale.

6. The gray scale display method according to claim 1, wherein the displaying a part of the pixel units of the pixel module with the preset gray scale comprises:

determining the preset gray scale of the part of the pixel units, according to a corresponding relation between gray scale and brightness of the pixel module.

7. The gray scale display method according to claim 2, wherein the displaying a part of the pixel units of the pixel module with the preset gray scale comprises:

displaying the pixel units of at two diagonal lines in the pixel module sequentially in turn at different module display time, wherein the module display time is a display time of a frame of picture displayed by the pixel module.

8. The gray scale display method according to claim 2, wherein the displaying a part of the pixel units of the pixel module with the preset gray scale comprises:

displaying four pixel units in the pixel module sequentially in turn at different module display time, wherein the module display time is a display time of a frame of picture displayed by the pixel module.

9. A gray scale display method, comprising:

determining a quantity of rows and columns of pixel units in a pixel module, and determining the pixel units for display in the pixel module;

determining whether to perform a module display of the pixel module;

determining a gray scale value of each pixel unit in the pixel module; and determining an in-turn display mode.

10. The gray scale display method according to claim 9, wherein the determining whether to perform the module display of the pixel module comprises:

determining whether to divide the pixel module for display, by calculating an average gray scale and a gray scale variance of the pixel module.

11. The gray scale display method according to claim 10, wherein the determining whether to divide the pixel module for display by calculating the average gray scale and the gray scale variance of the pixel module comprises:

in a case that the average gray scale of the pixel module is smaller than a set value, dividing the pixel module for displaying; or in a case that the average gray scale of the pixel module is smaller than a set value and the gray scale variance is smaller than a preset variance value, dividing the pixel module for displaying.

12. The gray scale display method according to claim 9, wherein the determining the gray scale value of each pixel unit in the pixel module comprises:

determining the gray scale value of each pixel unit in the pixel module corresponding to each frame picture, according to a corresponding relation between gray scale and brightness of the pixel module.

13. The gray scale display method according to claim 9, wherein the determining the in-turn display mode comprises:

displaying the pixel units of at two diagonal lines in the pixel module sequentially in turn at different module display time, wherein the module display time is a display time of a frame of picture displayed by the pixel module.

14. The gray scale display method according to claim 9, wherein the determining the in-turn display mode comprises:

displaying four pixel units in the pixel module sequentially in turn at different module display time, wherein the module display time is a display time of a frame of picture displayed by the pixel module.

* * * * *